US005678470A

United States Patent [19]

Koehler et al.

[11] Patent Number: 5,678,470

[45] Date of Patent: Oct. 21, 1997

[54] TILT PRIORITY SCHEME FOR A CONTROL SYSTEM

[75] Inventors: Douglas W. Koehler, Naperville; John J. Krone, Dunlap, both of Ill.

[73] Assignee: Caterpillar Inc., Peoria, Ill.

[21] Appl. No.: 684,074

[22] Filed: Jul. 19, 1996

[51] Int. Cl.[6] ..... F15B 11/00

[52] U.S. Cl. ..... 91/516; 91/532; 91/459; 60/327; 60/427

[58] Field of Search ..... 91/516, 532, 959, 91/508; 60/327, 328, 427

[56] References Cited

U.S. PATENT DOCUMENTS 4,586,330 5/1986 Watanabe et al. ..... 60/427 X 5,249,421 10/1993 Lunzman ..... 60/427 X 5,287,699 2/1994 Takamura et al. ..... 60/328 X 5,490,384 2/1996 Lunzman ..... 60/327

5,564,274 10/1996 Denbraber et al. ..... 60/427 X

*Primary Examiner*—Hoang Nguyen

*Attorney, Agent, or Firm*—Calvin E. Glastetter

[57] ABSTRACT

A control system is typically used for controlling the implements of a machine. The control system includes a lift circuit and a tilt circuit. The control system includes a module which receives a signal from the lift circuit and the tilt circuit and selects a signal for controlling a valve to meter pump-to-cylinder fluid flow.

4 Claims, 1 Drawing Sheet

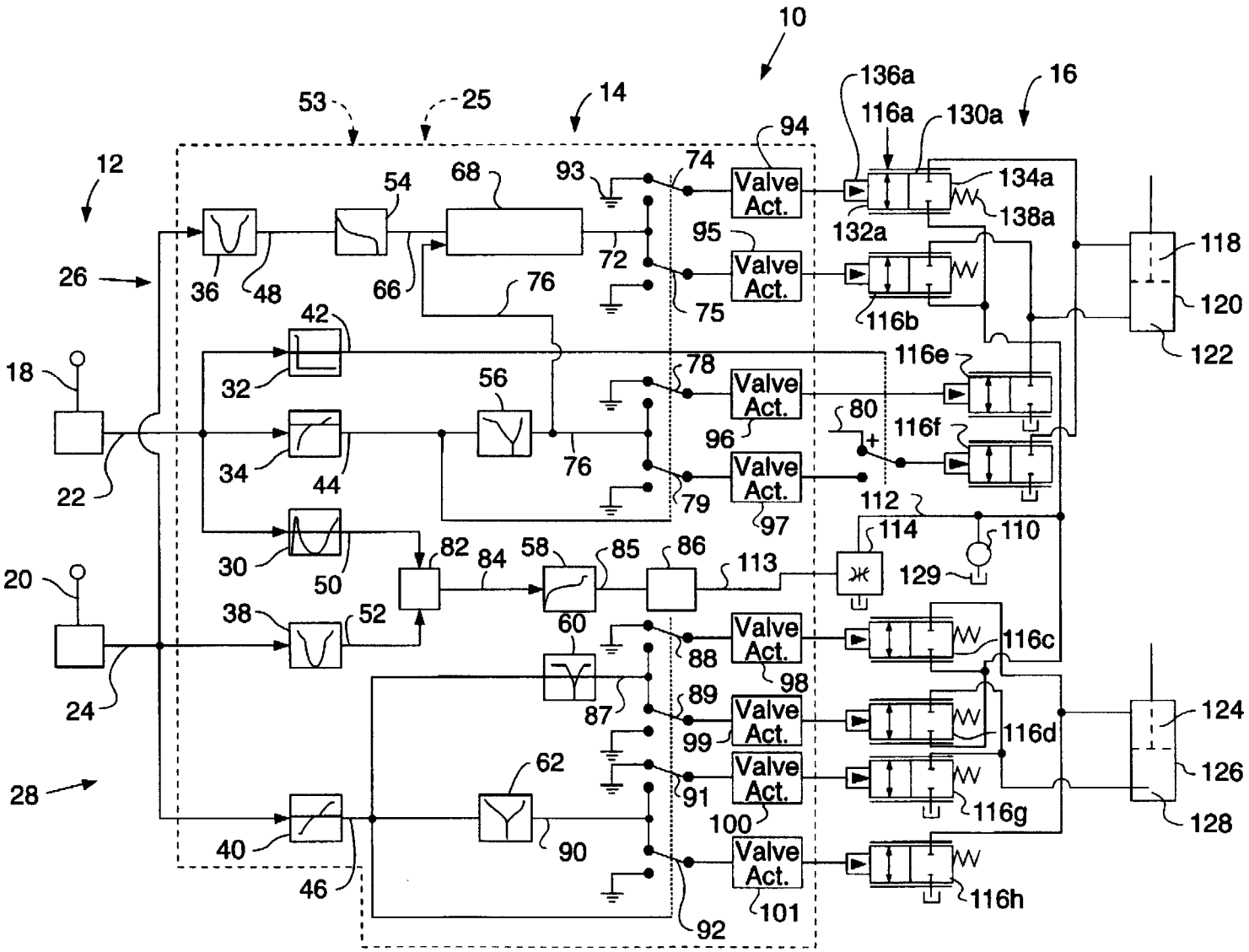
Valve Act.
Valve Act.
Valve Act.
Valve Act.
Valve Act.
Valve Act.
Valve Act.
Valve Act.

TILT PRIORITY SCHEME FOR A CONTROL SYSTEM

TECHNICAL FIELD

This invention relates to a control system for the implements of a machine and more particularly to a control system that meters the pump-to-cylinder flow to the lift actuator as a tilt command is increased.

BACKGROUND ART

A control system typically used to control the implement, such as a bucket, of a machine uses series bypass to control the relative flow between the lift and tilt circuits of the implement. A portion of the flow to the lift circuit is diverted to the tilt circuit when both are commanded. The tilt priority is handled hydraulically by metering fluid flow to the lift circuit as tilt is commanded. A problem occurs when a system is used which provides flow to all valves from a common source pressure tilt priority is not available hydraulically and must be provided in a different manner.

The present invention is directed to overcoming one or more of the problems as set forth above.

DISCLOSURE OF THE INVENTION

In one aspect of the present invention, a control system includes a lift circuit and a tilt circuit. A first control signal from the lift circuit indicates a lift command. A second control signal from the tilt circuit indicates a tilt command. A valve is used to control the pump-to-cylinder fluid flow. A limiter module receives the first and second control signals and control the valve relative to the control signals for metering the pump-to-cylinder fluid flow to provide tilt priority.

In another aspect of the present invention, a method for providing a tilt priority scheme in a control system having a lift circuit and a tilt circuit comprising the steps of sensing a control signal from the lift circuit, sensing a control signal from the tilt circuit, comparing the sensed control signals, selecting the control signal having the lower value and controlling the valve relative to the selected signal for metering pump-to-cylinder fluid flow.

BRIEF DESCRIPTION OF THE DRAWINGS

The sole FIGURE is a diagrammatic flow chart and hydraulic system of the present invention.

BEST MODE FOR CARRYING OUT THE INVENTION

A control system 10 is shown for controlling the implements of a machine, for example the bucket of a wheel loader, (not shown). The control system 10 includes an operator input control section 12, an electronic control section 14 and a hydraulic control section 16.

The operator input control section 12 includes a first implement lever 18 for lifting and lowering the implement of the machine and a second implement lever 20 for controlling the rackback and dump of the implement. The movement of the first implement lever 18 produces an electrical control signal 22 which is sent to the electronic control section 14. The movement of the second implement lever 20 produces an electrical control signal 24 which is also sent to the electronic control section 14. The control signals 22, 24 are positive when the implement levers 18, 20 are moved to lift and rackback the implement. The control signals 22, 24 are negative when the implement levers 18,20 are moved to lower or dump the implement.

The electronic control section 14 can be in the form of a microprocessor 25 or any other suitable system for controlling the hydraulic control section 16. The electronic control section 14 includes a lift circuit 26 for lifting/lowering the implement and a tilt circuit 28 for rackback/dumping the implement. The control signal 22 from the first lever 18 is sent to a pressure map 30, a float logic map 32 and a modulation map 34 within the lift circuit 26. The control signal 24 from the second control lever 20 is sent to a pressure map 36, a pressure map 38 and a modulation map 40 within the tilt circuit 28. The maps 30–40 convert the operator input signals 22, 24 into two separate requirements, such as one requirement being a plurality of desired implement velocity signals 42, 44 and 46. The second requirement being a plurality of desired pressure signals 48, 50 and 52. The maps 30–40 are in the form of lookup tables which receive the operator input signals 22, 24 and converts them into the desired implement velocity or pump pressure and sends the signals to a second plurality of maps 53.

The second plurality of maps 53 determine what needs to be actuated in order to meet the desired requirements. The second plurality of maps 53 includes a combination of pressure and flow modulation maps 54–62. Pressure map 54 receives the input signal 48 and determines what command is necessary and sends a signal 66 to a limiter module 68, which will be explained in greater detail later. The limiter module 68 sends a signal 72 to a switch 74 and a switch 75. Flow modulation map 56 receives the input signal 44 and sends a signal 76 to a switch 78 and a switch 79. Signal 44 is also used to control the position of the switches 74,75,78 and 79. Signal 42 is used to control the position of a float control switch 80. Signals 50,52 are sent to a selector module 82 which selects the larger of the two signals 50,52 and sends a selected signal 84 to the map 58. Map 58 sends a signal 85 to an actuator 86. Flow modulation maps 60,62 receive the input signal 46. Map 60 sends a signal 87 to a switch 88 and a switch 89. Map 62 sends a signal 90 to a switch 91 and a switch 92. Signal 46 is also used to control the position of the switches 88,89,91 and 92. The switches are constructed so that when a positive signal is received switches 75,79,89 and 92 are connected to the respective signal and the other switches 74,78,88 and 91 are connected to a ground 93. When a negative signal is received the switch connections are reversed. Switches 74,75,78,79,88, 89,91, and 92 are connectable to a respective actuator 94,95,96,97, 98,99,100, and 101.

The limiter module 68 receives the signal 66 from the map 54 and the signal 76 from the map 56. The limiter module 68 will select the signal 66,76 having the lower value and send the signal 72 to the switches 74,75. Tilt priority is provided by metering flow through the valves 116a,116b. As the tilt command is increased the pump-to-cylinder flow is reduced to restrict cylinder movement. The cylinder-to-tank flow is controlled by the command to the lift circuit. The pump-to-cylinder flow is controlled by the command to the tilt circuit. The limiter module 68 will meter the pump-to-cylinder flow to provide tilt priority.

The hydraulic control section 16 includes a supply pump 110. A line 112 connects the supply pump 110 to a bypass valve 114. A signal 113 from the actuator 86 is connected to the bypass valve 114 for controlling the pressure within the hydraulic control section 16. The line 112 also connects the supply pump 110 to a plurality of independently operable solenoid displacement controlled flow metering spool valves **116*a*,116*b*, 116*c* and 116*d*. The valve 116*a* is connected to a rod end chamber 118 of a hydraulic actuator 120 and the valve 116***b* is connected to a head end chamber 122 of the hydraulic lift actuator 120. The valve 116*c* is connected to a rod end chamber 124 of a hydraulic tilt actuator 126 and the valve 116*d* is connected to a head end chamber 128 of the hydraulic actuator 126. Another plurality of independently operable solenoid displacement controlled flow metering spool valves 116*e*,116*f*,116*g* and 116*h* are disposed between the hydraulic actuators 120,126 and a tank 129. The valve 116e is connected to the head end chamber 122 and the valve 116*f* is connected to the rod end chamber 118 of the hydraulic actuator 120. The valve 116*g* is connected to the head end chamber 128 and the valve 116*h* is connected to the rod end chamber 124 of the hydraulic actuator 126. The spool valves 116*a*,116*b*, 116*c*,116*d* control pump-to-cylinder fluid flow to the actuating chambers and the spool valves 116*e*,116*f*,116*g*,116*h* control cylinder-to-tank fluid flow from the actuating chambers to the tank. Each of the spool valves 116*a*, 116*b*,116*c*,116*d*, 116*e*,116*g*, 116*h* are connected to the respective actuator 94,95,96,97,98,99,100, 101. The spool valve 116*f* is connectable to the actuator 97 by the float switch 80. The valves 116*a*,116*b*, 116*e*,116*f* are controlled to extend the hydraulic actuator 120 for lifting the implement and to retract the actuator 120 for lowering the implement. The valves 116*c*,116*d*, 116*g*,116*h* are controlled to retract the hydraulic actuator 126 for rackback of the implement and to extend the actuator 126 for dumping the implement.

Each of the spool valves 116*a*,116*b*, 116*c*,116*d*, 116*e*, 116*f*,116*g*, 116*h* are substantially identical with only spool valve 116*a* being described in detail with common reference numerals applied to the elements of all of the spool valves followed by the appropriate letter. Each of the spool valves includes a solenoid actuated valve spool 130*a* having opposite ends 132*a*,134*a*. A solenoid 136*a* disposed on the end 132*a* is connected to the respective actuator such as 94. A spring 138*a* is disposed at the end 134*a* opposite the solenoid 136*a*. The spring 138*a* normally biases the valve spool 130*a* to a neutral or non-energized position. The spool valves are shown in their neutral positions occupied when the control levers 18,20 are centered.

Industrial Applicability

In the use of the present invention, the electronic section 14 of the control system 10 defines the movement necessary in the hydraulic section 16 for controlling the implement of a machine. The electronic section 14 includes the lift circuit 26 and the tilt circuit 28.

To extend the actuator 120 and lift the implement the control lever 18 is moved and the signal 22 is sent to the lift circuit 26 of the electronic section 14. To tilt the implement the control lever 20 is moved and the signal 24 is sent to the tilt circuit 28 of the electronic section 14. The limiter module 68 receives the signal 66 from the tilt circuit 28 when tilt is actuated and the signal 76 from the lift circuit 26 when lift is actuated. The limiter module 68 will compare the two signals 66,76 and the select the signal having the smaller value. The selected signal 72 will be sent to one of the actuators 94 or 95, depending on the position of the switches 74,75. The actuator will control the respective valve. The valve will meter the pump-to-cylinder fluid flow to restrict cylinder movement. Metering the pump-to-cylinder will ensure that the tilt has priority over the lift.

In view of the above, it is readily apparent that the control system will meter the pump-to-cylinder fluid flow when the tilt circuit is actuated. The control system will modify the signals to provide a tilt priority when tilt is commanded.

Other aspects, objects and advantages of this invention can be obtained from a study of the drawing, the disclosure and the appended claims.

We claim:

1. A control system having a tilt priority scheme, the control system includes a lift circuit and a tilt circuit, comprising:

a first control signal from the lift circuit indicates a lift command;

a second control signal from the tilt circuit indicates a tilt command;

a valve for controlling pump-to-cylinder fluid flow; and a limiter module which receives the first control signal, the second control signal, and selects the smaller of the two signals to control the valve relative to the control signals for metering the pump-to-cylinder fluid flow to provide for tilt priority.

2. The control system of claim 1 includes a second valve controlled by the first control signal for controlling the cylinder-to-tank fluid flow.

3. The control system of claim 2 wherein the valves are two position independently operable solenoid displacement controlled flow metering valves.

4. A method of providing a tilt priority scheme in a control system having a lift circuit with a control valve and a tilt circuit, the method comprising the steps of:

sensing a control signal from the lift circuit;

sensing a control signal from the tilt circuit;

comparing the sensed control signals;

selecting the control signal having the lower value; and controlling the valve relative to the selected signal for metering pump-to-cylinder fluid flow.

* * * * *